US007616096B1

(12) United States Patent
Sorensen

(10) Patent No.: US 7,616,096 B1
(45) Date of Patent: Nov. 10, 2009

(54) EASY-TO-READ BREAKER PANEL

(76) Inventor: Fred Sorensen, 2525 Aero Park Dr., Cedar, MI (US) 49686

( * ) Notice: Subject to any disclaimer, the term of this patent is extended or adjusted under 35 U.S.C. 154(b) by 247 days.

(21) Appl. No.: 11/841,113

(22) Filed: Aug. 20, 2007

(51) Int. Cl.
*B61L 25/08* (2006.01)

(52) U.S. Cl. ..... 340/286.13; 340/815.4

(58) Field of Classification Search ..... 340/815.4, 340/286.13
See application file for complete search history.

(56) References Cited

U.S. PATENT DOCUMENTS 3,794,800 A 2/1974 Bodge
4,222,039 A * 9/1980 Cronin ..... 340/815.47
4,483,588 A 11/1984 Dalbo et al.
4,611,201 A 9/1986 Guim et al.
4,658,986 A * 4/1987 Freed et al. ..... 222/52
4,698,621 A * 10/1987 Masot ..... 340/639
4,895,455 A 1/1990 Horning
5,739,737 A 4/1998 Hatton
5,850,705 A 12/1998 Groh
5,874,884 A 2/1999 Hull et al.
6,154,032 A * 11/2000 Coia et al. ..... 324/424
6,628,192 B2 9/2003 Steinbicker

OTHER PUBLICATIONS

River Marine Supply, Paneltronics, archived webpage from catalog, Jun. 03, 2004, 3 pages, www.rivermarinesupply.com, US.
Blue Sea Systems, Label Backlight System, archived webpage from catalog, Dec. 6, 2002, www.blueseasystems.com, US.
IP COM, Illuminated Circuit Breaker Panel, webpage abstract from online database, 2004, www.priorartdatabase.com, US.
IP COM, Illuminated Circuit Breaker Panel, webpage abstract from online database, 2004, 1 page, www.priorartdatabase.com, US.

* cited by examiner

*Primary Examiner*—Daniel Wu
*Assistant Examiner*—John F Mortell
(74) *Attorney, Agent, or Firm*—Northern Michigan Patent Law, PLC

(57) ABSTRACT

A movable reference guide mounted to slide over a circuit breaker reference chart on the door of a circuit breaker box to visually mark individual circuit breaker labels on the chart, and indicator lights associated with each of the circuit breakers on the breaker panel opposite the door, the indicator lights responsive to the position of the guide on the reference chart to light up when their corresponding labels are marked by the guide. In the preferred form the guide includes a magnifier lens to enlarge the writing on the labels.

6 Claims, 3 Drawing Sheets

EASY-TO-READ BREAKER PANEL

FIELD OF THE INVENTION

The present invention is in the field of circuit breaker panels, and more particularly in the field of labeled breaker charts found on the doors of circuit breaker panel enclosures.

BACKGROUND OF THE INVENTION AND DESCRIPTION OF RELATED ART

Circuit breaker panels in most households and other buildings typically include a box-like enclosure with a regular array of breakers, for example arrayed in two parallel columns. The enclosure is typically protected with a door that can be latched shut. A printed reference chart or key is typically located on the inside surface of the door, organized with individual labels corresponding in number and position to the array of breakers (e.g., two parallel columns) so that a person servicing the panel, checking for tripped breakers, or disabling circuits prior to making electrical repairs elsewhere in the building can identify which breakers control which circuits or appliances.

Anyone who has ever tried to decipher the scribblings of successive homeowners or electricians on the reference chart will appreciate that the circuit labels are often difficult to read, especially in the cramped confines and poor lighting of the typical breaker panel location in a basement, utility closet, garage corner, etc. This difficulty is made worse if the circuit diagnosis is being made during a power outage or emergency, especially if by someone unfamiliar with the house or the particular panel.

It can also be difficult to make back-and-forth visual correspondence between the reference chart on the inside of the open door and the rows and columns of breakers on the opposing panel.

Even if the breaker reference chart is reasonably legible (a rarity) and well lit, the breakers themselves are normally not labeled, and visual correspondence must often be based on a number faintly stamped into the metal of the breaker panel next to the breaker.

BRIEF SUMMARY OF THE INVENTION

The present invention solves the foregoing problems with a reference guide mounted to move over the breaker reference chart on the door. The guide visually marks or outlines one or more labels, and is connected to activate a signal light associated with the corresponding breaker(s) on the breaker panel opposite the door.

In the preferred form, the movable reference guide slides up and down over the reference chart, and includes a magnifier lens to further distinguish the writing on the labels.

The movable reference guide can also include a light to illuminate the label being marked by the guide.

The signal lights associated with the breakers are preferably light emitting diodes (LEDs), and are preferably mounted in the breaker panel next to each breaker. The signal lights enabled by the movable guide could alternately be built into the breakers themselves.

These and other features and advantages of the invention will become apparent upon further reading of the specification, in light of the accompanying drawings.

DETAILED DESCRIPTION OF THE INVENTION

Figure 1:
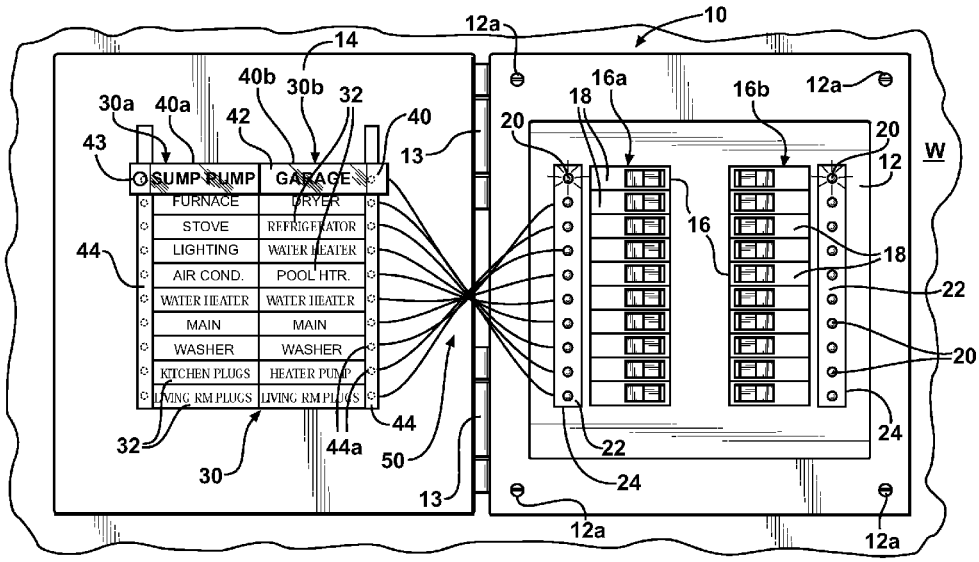
FIG. 1 is a front elevation view of a circuit breaker panel, modified according to the present invention with a movable reference guide over the breaker reference chart on the door, and with guide-activated signal lights in the breaker panel opposite the door.
Figure 1A:
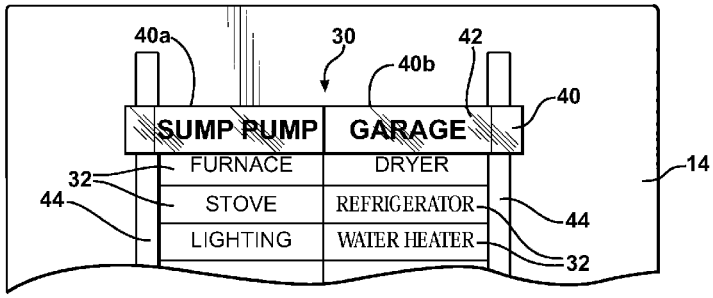
FIG. 1A is a detail of the movable guide and of the reference chart labels being marked in FIG. 1.

Referring first to FIGS. 1 and 1A, the invention is illustrated in a preferred example in which a breaker box or enclosure 10 has a breaker panel 12 mounted in or on a wall W, for example with screws 12*a*, and a door 14 connected to panel 12 with hinges 13. Door 14 is shown in its open position for inspection of the panel 12, but would normally be closed to cover the panel. Breaker panel 12 and door 14 are typically made from stamped metal, although the use of other materials such as various plastics is possible.

Circuit breakers 18 are mounted in slots 16 in panel 12, in known manner. Slots 16 and breakers 18 are shown arranged in a common layout, with two parallel columns 16*a* and 16*b*. It will be understood by those skilled in the art that while two parallel, equal columns of breakers 18 are illustrated for purposes of describing the invention, representing a typical panel arrangement, the layout and number of breakers 18 in panel 12 can vary.

Each of breakers 18 has an associated selectively-activated indicator light 20, in the preferred form a light emitting diode (LED) of known type using low voltage and current, although non-LED lights could be used. Lights 20 are located immediately adjacent their respective breakers 18 next to slots 16, for example mounted on electrically insulating panels or strips 22 fitted into vertical slots 24 formed in panel 12 for that purpose.

Door 14 has a breaker reference chart 30, with individual labels 32 corresponding in number and position to breakers 18 on panel 12 in known fashion. Accordingly, illustrated chart 30 has labels 32 arranged in two columns 30*a* and 30*b* corresponding to columns 16*a* and 16*b* on panel 12. Reference chart 30 can be adhesive-backed paper, with the labels 32 being simple blanks filled in with pencil or pen, or a grid stamped lightly into the metal or plastic of door 14 with blank or pre-printed labels 32 applied individually, or any other form of pre-printed, pre-formed, or fill-in-the-blank breaker reference chart. As illustrated, the breaker labels are usually filled in with the name of an appliance, or of a room or wing of the building, indicating the device or circuit protected by the corresponding breaker(s) 18 on panel 12. The writing on labels 32 is typically fairly small, since the typical panel 12 has a large number of breakers 18, with chart 30 having a correspondingly large number of labels 32 that must fit on the limited space of door 14.

Reference chart 30 is modified according to the invention with a movable reference guide 40, in the illustrated embodiment a rectangular frame made from metal or plastic, defining two rectangular label-framing "windows" or slots 40*a* and 40*b* sized and shaped to simultaneously outline or mark one row (comprising a pair) of adjacent labels 32 in columns 30*a* and 30*b*, corresponding to one row of breakers 18 on the opposing panel. In the illustrated, preferred embodiment, reference guide 40 moves by sliding on parallel vertical rails 44 located on each side of chart 30. Other types of sliding connection are possible, including but not limited to slots instead of rails.

At least one of the rails 44 is provided with a plurality of electrical contacts or switches illustrated schematically at 44*a* in association with each row of labels 32, closed or activated by the presence of guide 40 over the corresponding labels 32, and connected by suitable wiring or signal connection, schematically illustrated as wires 50, to activate LEDs 20 on panel 12. For ease of reference in the drawings, wires 50 are illustrated as being exposed, running directly between the right-hand rail 44 on door 14 across hinges 13 to light strip 22 on panel 12, but it will be understood by those skilled in the art that any wiring would preferably be hidden, for example by routing the wires through an interior space in door 14, behind chart 30 and rails 44, and/or by routing them behind the wall-mounted panel 12 for hidden connections to the lights 20. It will also be understood by those skilled in the art that the connection between movable guide 40 and the respective indicator lights 20 can be a direct electrical circuit, the closing of which activates the lights, or a signal connection that closes a separate circuit to power the lights 20. Both wired and wireless signal connections are therefore possible.

It will accordingly be understood by those skilled in the art that wiring 50 is a schematic representation of many possible forms of electrical or signal connection for activating lights 20 in response to the position of guide 40 relative to the labels 32 on chart 30. It will also be understood that a single contact or switch 44*a* would be sufficient for each horizontal row of labels 32*a*, since the lights 20 corresponding to that row on panel 12 can be connected for simultaneous illumination in response to the closing or activation of a single contact or switch 44*a* on door 14.

FIGS. 1 and 1A also illustrate the preferred option of a magnifying lens or lenses 42 located in, or defining, the label-framing windows 40*a* and 40*b* on guide 40, in order to magnify the lettering on labels 32. A small light 43 can also be mounted on guide 40, for example an LED positioned to direct light onto the labels being magnified by guide 40, in addition to magnifier 42. Light 43 would be especially helpful during power outages, and for this purpose a UPS-type battery backup of known type (shown schematically in FIG. 3 at 150) could be connected to automatically turn light 43 on to illuminate the magnified labels 32. The battery backup could also be connected to supply emergency power for indicator lights 20 when the normal power supply is interrupted.

Figure 2:
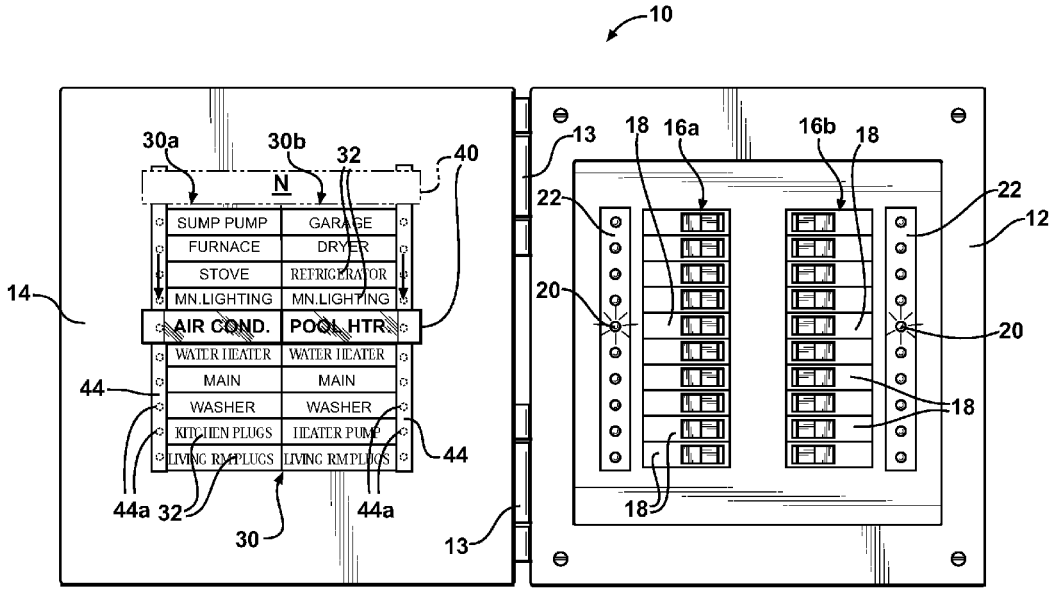
FIG. 2 is similar to FIG. 1, but shows the movable reference guide located over a different row of labels on the reference chart, and a different set of corresponding lights activated on the breaker panel.

FIG. 2 shows guide 40 moved partway down the reference chart 30, to outline, magnify, and optionally illuminate a different row of labels 32. A different set of lights 20 is accordingly illuminated next to the corresponding breakers 18 for those circuits on panel 12. Lights 20 corresponding to the labels 32 being marked by guide 40 preferably stay lit continuously while guide 40 remains over the labels, and turn off when guide 40 is moved to a different set of labels on chart 30.

FIG. 2 also illustrates, in phantom lines, a neutral position N for reference guide 40, located on upper ends of rails 44 above the uppermost row of labels 32 on chart 30. None of lights 20 is activated when guide 40 is parked in the neutral position N above the labels on the chart.

Figure 3:
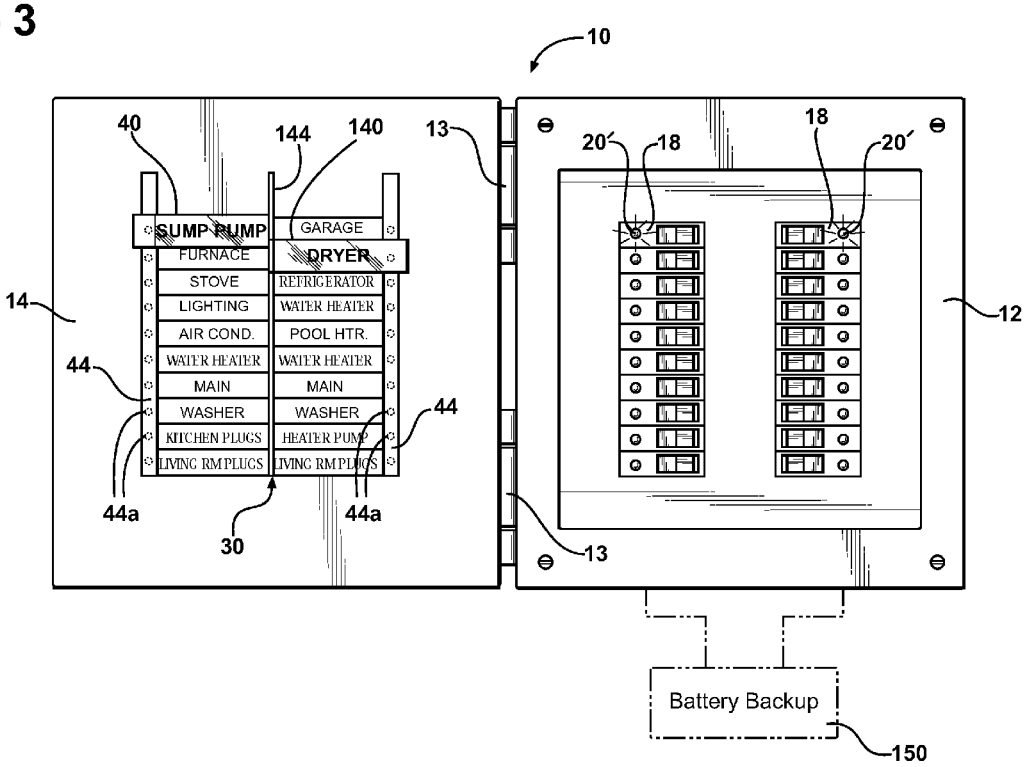
FIG. 3 is similar to FIG. 1, but shows the signal lights located on the breakers themselves, and a movable reference guide separated into two sliding portions, each one sliding independently over one of the columns on the reference chart.

FIG. 3 illustrates an alternate embodiment of the invention, in which lights 20' are built directly into breakers 18.

FIG. 3 also illustrates a modified reference guide, similar to FIG. 1, but split into two portions 40 and 140, separately movable over reference chart 30 to mark and illuminate a single label/breaker combination at a time. One or more additional rails or slots 144 are preferably added to better support the inner ends of the two sliding guides.

While reference guide 40 preferably moves by sliding over the chart 30 on door 14, other forms of movable connection between guide 40 and door 14 enabling the guide to activate or signal lights 20 are within the scope of the invention. The guide 40 and indicator lights 20 (and associated support structure and signal and power connections) are preferably originally built into the breaker box 10, but could also be added as a retrofit kit to existing breaker boxes.

It will be understood that the disclosed embodiments are representative of presently preferred forms of the invention, but are intended to be illustrative rather than definitive of the invention, and that reasonable variation and modification of the illustrated embodiments is possible within the scope of the invention. The scope of the invention is defined by the following claims. I accordingly claim:

The invention claimed is:

1. In a circuit breaker enclosure comprising a breaker panel with circuit breakers and a door with a breaker reference chart comprising breaker labels corresponding to the circuit breakers on the panel, a label/breaker correspondence apparatus comprising:

a reference guide mounted to move over the breaker reference chart on the door, the guide visually marking one or more breaker labels at a time, and an indicator light associated with each of the circuit breakers on the breaker panel opposite the door, the indicator light for each circuit breaker activated when the guide marks a label on the chart corresponding to the circuit breaker.

2. The apparatus of claim 1, wherein the guide is mounted to slide over the reference chart.

3. The apparatus of claim 1, wherein the guide is sized to frame one or more labels on the chart, and further comprises a magnifier to visually enlarge the one or more labels being framed.

4. The apparatus of claim 1, wherein the guide includes a light for illuminating the one or more labels being visually marked.

5. The apparatus of claim 1, wherein the guide comprises two independently movable guides to independently mark two labels.

6. The apparatus of claim 1, further comprising a battery backup connected to power the indicator lights during an interruption of a normal power supply to the indicator lights.

* * * * *